US005238798A

United States Patent [19]

Usami

[11] Patent Number: 5,238,798

[45] Date of Patent: Aug. 24, 1993

[54] SILVER HALIDE PHOTOGRAPHIC MATERIAL CONTAINING DISPERSED DYE

[75] Inventor: Takashi Usami, Kanagawa, Japan

[73] Assignee: Fuji Photo Film Co., Ltd., Kanagawa, Japan

[21] Appl. No.: 873,981

[22] Filed: Apr. 27, 1992

Related U.S. Application Data

[63] Continuation-in-part of Ser. No. 706,689, May 29, 1991, abandoned.

[30] Foreign Application Priority Data

Jun. 1, 1990 [JP] Japan ..... 2-143861

[51] Int. Cl.[5] ..... G03C 1/00

[52] U.S. Cl. ..... 430/522; 430/510; 430/517

[58] Field of Search ..... 430/510, 517, 522, 584

[56] References Cited

U.S. PATENT DOCUMENTS 3,502,474 3/1970 Tsuda et al. .
4,288,534 9/1981 Lemahieu et al. ..... 430/522
4,960,686 10/1990 Kawashima et al. ..... 430/522

FOREIGN PATENT DOCUMENTS 0015601 9/1980 European Pat. Off. .
1114323 5/1968 United Kingdom .
1338799 11/1973 United Kingdom .

*Primary Examiner*—Jack P. Brammer
*Attorney, Agent, or Firm*—Sughrue, Mion, Zinn, Macpeak & Seas

[57] ABSTRACT

A silver halide photographic material having on a support a hydrophilic colloid layer containing at least one 2-pyrazoline-5-one oxonol dye represented by formula (I) in the form of a dispersion of fine solid particles thereof;

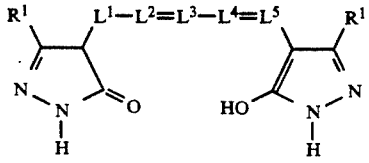

(I)

wherein $R^1$ represents a hydrogen atom, an aryl group, a cyano group, a halogen atom, $—COOR^2$, $—COR^3$, $—ONR^3R^4$, $—OR^2$, $—NHCOR^3$, or $—NR^3R^4$ (wherein $R^2$ represents an alkyl group or an aryl group and $R^3$ and $R^4$ each represents a hydrogen atom, an alkyl group, or an aryl group); and $L^1$, $L^2$, $L^3$, $L^4$, and $L^5$ each represents a methine group.

6 Claims, No Drawings

SILVER HALIDE PHOTOGRAPHIC MATERIAL CONTAINING DISPERSED DYE

CROSS-REFERENCE TO RELATED APPLICATION

This is a continuation-in-part application of U.S. application Ser. No. 07/706,689, filed May 29, 1991 now abandoned.

FIELD OF THE INVENTION

The present invention relates to a silver halide photographic material having a dyed hydrophilic colloid layer, and more particularly to a silver halide photographic material having a hydrophilic colloid layer containing a dye which is photochemically inactive and is easily decolored and/or dissolved out in a photographic processing step.

BACKGROUND OF THE INVENTION

In silver halide photographic materials, it has been frequently practiced to color the photographic silver halide emulsion layers and other hydrophilic colloid layer(s) for absorbing light of a specific wavelength.

When it is necessary to control the spectral composition of light entering a photographic silver halide emulsion layer of a silver halide photographic material, a colored layer is usually formed at the side farther from the support than the photographic emulsion layer. Such a colored layer is known as a filter layer. When a photographic light-sensitive material has plural photographic emulsion layers, a filter layer may be added between the photographic emulsion layers.

A colored layer known as an antihalation layer is provided to prevent dimming of images (halation) caused by light that is scattered during or after passing through photographic emulsion layers, which scattered light is reflected at the interface between the emulsion layer and the support and/or at the surface of the support opposite to the emulsion layer side, and then reenters the photographic emulsion layer. When plural photographic emulsion layers are present, the antihalation layer is sometimes interposed between these photographic emulsion layers.

Furthermore, the photographic emulsion layer(s) can be colored to prevent a reduction in image sharpness caused by light scattering at photographic emulsion layer(s) (this phenomenon is generally known as "irradiation").

In many cases, colored layers are formed of hydrophilic colloids. For coloring these hydrophilic colloid layers, a dye is usually incorporated in the hydrophilic colloid layers. The dye being used for the purpose must satisfy the following requirements.

(1) The dye has an appropriate spectral absorption according to the desired application.

(2) The dye is photochemically inactive. Specifically, the dye does not exert adverse chemical effects on the performance of the silver halide photographic emulsion layers, for example, a reduction in sensitivity, fading of latent images formed and fog.

(3) The dye is decolorized during photographic processing or is dissolved out in the processing solution or wash water during processing so as to not leave harmful residual color in the photographic light-sensitive material after processing.

(4) The dye does not diffuse into other layers from the dyed layer.

(5) The dye is excellent in stability over time in solution or in the photographic light sensitive material and does not cause discoloration or fading.

In particular, when the colored layer is a filter layer or an antihalation layer provided at the same side as the photographic emulsion layer side of the support, it is frequently required that the layer only is selectively colored and the coloring does not substantially affect other layers. The reason is that if the coloring affects other layers, it not only provides a harmful spectral effect to other layers, but also the efficacy of the filter layer or the antihalation layer is reduced.

However, when the layer containing the dye is brought into contact with other hydrophilic colloid layer in a wet state, a part of the dye frequently diffuses from the dye layer to the other layer. For preventing this diffusion of the dye many methods have been proposed.

For example, a method of providing a dissociated anionic dye and a hydrophilic polymer having an opposite charge as a mordant in a layer to localize the dye in the specific layer by the interaction of the mordant with the dye molecule is disclosed in U.S. Pat. Nos. 2,548,564, 4,124,386, and 3,625,694.

Also, a method of dyeing a specific layer using fine particles of a metal salt adsorbed with a dye is disclosed in U.S. Pat. Nos. 2,719,088, 2,496,841, and 2,496,843 and JP-A-60-45237 (the term "JP-A" as used herein means an "unexamined published Japanese patent application").

Also, a method of dyeing a specific layer using a water-insoluble solid dye is disclosed in JP-A-55-120030, JP-A-56-12639, JP-A-55-155350, JP-A-55-155351, JP-A-63-27838, JP-A-63-197943, JP-A-52-92716, European patents 15601, 276566, 274723, 276566, and 299435, and WO 88/04794.

However, even when using these methods, there is a problem of diffusion of the dye in a dye-fixing layer. When changing various factors to quicken processing, such as improving the compositions of processing solutions or improving the composition of photographic silver halide emulsions there is a problem in that the decolorizing function of the dye is not always satisfactory due to the delayed decolorizing rate at photographic processing.

SUMMARY OF THE INVENTION

An object of the present invention is to provide a silver halide photographic material containing dispersed fine solid particles of a dye so as to dye a specific hydrophilic colloid layer in the photographic light-sensitive material and be quickly decolorized during development processing without diffusing into other layers especially during the storage of the photographic light-sensitive material.

It has now been discovered that the above and other objects have been achieved by a silver halide photographic material having on a support a hydrophilic colloid layer containing at least one compound represented by general formula (I) in the form of a dispersion of fine solid particles thereof;

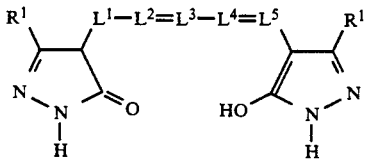

(I)

wherein $R^1$ represents a hydrogen atom, an aryl group, a cyano group, a halogen atom, $—COOR^2$, $—COR^3$, $—CONR^3R^4$, $—OR^2$, $—NHCOR^3$, or $—NR^3R^4$ (wherein $R^2$ represents an alkyl group or an aryl group and $R^3$ and $R^4$ each represents a hydrogen atom, an alkyl group, or an aryl group), and $L^1$, $L^2$, $L^3$, $L^4$, and $L^5$ each represents a methine group.

It is preferable that the methine group represented by $L^1$, $L^2$, $L^3$, $L^4$, and $L^5$ is unsubstituted, but the methine group may have a substituent such as methyl, ethyl, phenyl, etc.

The compound represented by the above-described general formula (I) is described in detail below.

DETAILED DESCRIPTION OF THE INVENTION

The aryl group shown by $R^1$ may have a substituent such as an alkyl group (e.g., methyl and ethyl), an alkoxy group (e.g., methoxy and ethoxy), a halogen atom (e.g., chlorine, bromine, and fluorine), an amino group (e.g., dimethylamino and diethylamino), a cyano group, and a phenoxy group. Further, $R^1$ may be bonded directly or through a divalent linkage group such as —O—, —S—, —NRCO—, —CONR—, $—(CH_2)_pOCO—$, —NHCONH—, —NHOCO—, etc., [wherein R represents an alkyl group having from 1 to 6 carbon atoms (e.g., methyl, ethyl, and n-hexyl) and p represents an integer of from 0 to 5].

Preferably, $R^1$ represents $—OR^2$, with $R^2$ being an alkyl group having from 1 to 5 carbon atoms.

Specific examples of the compound represented by general formula (I) are illustrated below but the invention is not limited to them.

| No. | $R^1$ | $=L_3—$ |
|---|---|---|
| I-1 | $CH_3O—$ | =CH— |
| I-2 | $CH_3CH_2O—$ | =CH— |
| I-3 | $CH_3CH_2CH_2O—$ | =CH— |
| I-4 | $CH_3CH_2CH_2CH_2O—$ | =CH— |
| I-5 | $CH_3CH_2CH_2CH_2CH_2O—$ | =CH— |
| I-6 | $—CO_2CH_3$ | =CH— |
| I-7 | $—CO_2CH_2CH_3$ | =CH— |
| I-8 | $—CO_2CH_2CH_2CH_3$ | =CH— |
| I-9 | —CN | =CH— |
| I-10 | $—COCH_3$ | =CH— |
| I-11 | $—COCH_2CH_3$ | =CH— |
| I-12 | 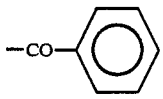 | =CH— |
| I-13 | $—CON(CH_3)_2$ | =CH— |
| I-14 | $—CON(C_2H_5)_2$ | =CH— |
| I-15 | $—NHCOCH_3$ | =CH— |
| I-16 | $—NHCOCH_2CH_3$ | =CH— |
| I-17 | 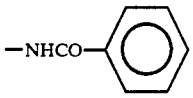 | =CH— |

-continued

| No. | $R^1$ | $=L_3—$ |
|---|---|---|
| I-18 | 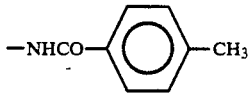 | =CH— |
| I-19 | $—NH_2$ | =CH— |
| I-20 | $—N(CH_3)_2$ | =CH— |
| I-21 | $—N(C_2H_5)_2$ | =CH— |
| I-22 | $—N(C_3H_7)_2$ | =CH— |
| I-23 | 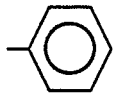 | =CH— |
| I-24 | 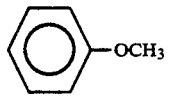 | =CH— |
| I-25 | $CH_3CH_2CH_2O—$ | $=C(CH_3)—$ |
| I-26 | 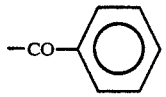 | $=C(CH_3)—$ |
| I-27 | 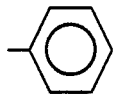 | $=C(CH_3)—$ |

In the compounds shown above, $L_1$, $L_2$, $L_4$, and $L_5$ are CH.

The compounds of general formula (I) can be synthesized according to the methods described in JP-A-52-92716, JP-A-63 316853, JP-A-64-40827, and JP-B-58-35544 (the term "JP-B" as used herein means an "examined published Japanese patent application").

The compound of general formula (I) is used in an amount of from 1 to 1000 mg, and preferably from 1 to 800 mg per square meter of a photographic light-sensitive material.

When the compound of general formula (I) is used as a filter dye or an antihalation dye, any suitable amount can be used, but it is preferred that the compound of formula (I) is used in an amount such that the optical density becomes from 0.05 to 3.5. The dye may be added to the coating composition of the layer at any step before coating.

The compound of general formula (I) can be used in a silver halide emulsion layer or other hydrophilic colloid layer.

The dispersion of fine particles of the compound of general formula (I) can be formed by a method of precipitating the compound of general formula (I) in the form of a dispersion thereof and/or a method of forming a dispersion using a known pulverizing means such as ball milling (e.g., using a ball mill, a vibrating ball mill, and an epicyclic ball mill), sand milling, colloid milling, jet milling, roller milling, etc., in the presence of a dispersing agent [in this case, a solvent (e.g., water and an alcohol) may be present in the system]. Alternatively, after dissolving the compound of general formula (I) in a proper solvent, a fine crystal powder of the compound may be precipitated by adding a poor solvent for the compound to the solution and in this case, a surface active agent for dispersion may also be added. Furthermore, the compound of general formula (I) can be first dissolved in a solvent by controlling the pH thereof, and then finely crystallized by changing the pH thereof.

The mean particle size of the fine crystal particles of the compound of general formula (I) in the dispersion is not larger than 10 μm, preferably not larger than 2 μm, and more preferably not larger than 0.5 μm. Fine crystal particles having a mean particle size of not larger than 0.1 μm is particularly preferred. Preferably the mean particle size of the fine crystal particles of the compound of general formula (I) in the dispersion is not less than 0.05 μm. The mean particle size of the fine crystal particles of the compound of general formula (I) in the dispersion can be from 0.05 μm to 10 μm, preferably from 0.05 μm to 2 μm, and more preferably from 0.05 μm to 0.5 μm, with the most preferred being from 0.05 μm to 0.1 μm.

As the hydrophilic colloid for use in the present invention, gelatin is typical but other hydrophilic colloids which are suitable for use with photographic light-sensitive materials can be used.

For the silver halide emulsion for use in the present invention, silver bromide, silver iodobromide, silver iodochlorobromide, silver chlorobromide, or silver chloride is preferably used.

The silver halide grains for use in the present invention may have a regular crystal form such as a cube and an octahedron, an irregular crystal form such as a sphere and a tabular form, or a composite form of these crystal forms. Also, a mixture of silver halide grains having various crystal forms can be used. In this invention, however, the use of the silver halide grains having a regular crystal form is preferably used.

The silver halide grains for use in the present invention may differ in phase between the inside and the surface layer thereof or may be uniform in phase throughout the whole grain. Also, the silver halide grains may form latent images mainly on the surface (e.g., a negative-working silver halide emulsion) or may form latent images mainly in the inside (e.g., an internal latent image type silver halide emulsion and a previously fogged direct reversal type silver halide emulsion). In this invention, the silver halide grains forming latent images mainly on the surface are preferably used.

The silver halide emulsion for use in the present invention is preferably a tabular grain silver halide emulsion containing silver halide grains wherein the grains having a thickness of not more than 0.5 μm, and preferably not more than 0.3 μm, a diameter of preferably at least 0.6 μm, and a mean aspect ratio of at least 5 account for at least 50% of the total projected area or a monodisperse silver halide emulsion having a statistical coefficient of variation (the value $S/\bar{d}$ obtained by dividing a standard deviation S by a diameter $\bar{d}$ in the distribution shown by the diameter in case where the projected area is approximated to a circle) of 20% or lower. Also, a mixture of tabular grain silver halide emulsion(s) and monodisperse silver halide emulsion(s) may be used.

The silver halide emulsions for use in the present invention can be prepared using the methods described in P. Glafkides, *Chimie et Physique Photographique,* published by Paul Montel Co., 1967; G. F. Duffin, *Photographic Emulsion Chemistry,* published by Forcal Press, 1966; and V. L. Zelkiman et al, *Making and Coating Photographic Emulsion,* published by Focal Press, 1964.

At the formation of the silver halide grains, ammonia, potassium thiocyanate, ammonium thiocyanate, thioether compounds (described in U.S. Pat. Nos. 3,271,157, 3,574,628, 3,704,130, 4,297,439 and 4,276,374), thione compounds (described in JP-A-53-144319, JP-A-53-82408, and JP-A-55-77737, or amine compounds (described in JP-A-54-100717) can be used as a silver halide solvent for controlling the growth of the silver halide grains.

At the step of forming or physically ripening silver halide grains, a cadmium salt, a zinc salt, a thallium salt, an iridium salt or complex salt thereof, a rhodium salt or complex salt thereof, or an iron salt or complex salt thereof may be present in the emulsion.

As the binder or the protective colloid which is used for the silver halide emulsion layers, interlayers, etc., of the photographic light-sensitive material of the present invention, gelatin is advantageously used, but other hydrophilic colloid can be used. For example, proteins such as gelatin derivatives, graft polymers of gelatin and other polymers, albumin, casein, etc.; cellulose derivatives such as hydroxyethyl cellulose, carboxymethyl cellulose, cellulose sulfuric acid esters, etc.; saccharose derivatives such as sodium alginate, starch derivatives, etc.; or various synthetic hydrophilic homopolymers or copolymers such as polyvinyl alcohol, polyvinyl alcohol partial acetal, poly-N-vinylpyrrolidone, polyacrylic acid, polymethacrylic acid, polyacrylamide, polyvinyl imidazole, polyvinyl pyrazole, etec., can be used.

As gelatin, ordinary lime-processed gelatin as well as acid-processed gelatin and enzyme-processed gelatin as described in *Bull. Soc. Sci. Phot. Japan,* No. 16, p. 30 (1966) can be used. Also, the hydrolyzed product of gelatin can be used.

The photographic light-sensitive material of the present invention may contain an optional inorganic or organic hardening agent in optional hydrophilic colloid layers constituting the photographic light-sensitive layers, and back layer thereof. Examples of such a hardening agent are chromium salts, aldehydes (e.g., formaldehyde, glyoxal, and glutaraldehyde), and N-methylol series compounds (e.g., dimethylolurea).

Also, active halogen compounds (e.g., 2,4-dichloro-6-hydroxy-1,3,5-triazine and the sodium salts thereof) and active vinyl compounds [1,3-bisvinyl-sulfonyl-2-propanol, 1,2-bis(vinylsulfonylacetamido)-ethane, bis(-vinylsulfonylmethyl)ether, and a vinylic polymer having a vinylsulfonyl group at the side chain) are preferably used as the hardening agent since they quickly harden hydrophilic colloids such as gelatin to give stable photographic characteristics. Furthermore, N-carbamoylpyridinium salts such as (1-morpholinocarbonyl-3-gyridinio)methane sulfonate, etc., and haloamidinium salts such as 1-(1-chloro-1-pyridinomethyl-ene)pyrrolidinium-2-naphthalene sulfonate, etc., are excellent in hardening rate.

The silver halide photographic emulsions for use in this invention may be spectrally sensitized with methine dyes, etc. The dyes which are used for this purpose include cyanine dyes, merocyanine dyes, complex cyanine dyes, complex merocyanine dyes, holopolar dyes, hemicyanine dyes, styryl dyes, and hemioxonol dyes. Particularly useful dyes are dyes belonging to cyanine dyes, merocyanine dyes, and complex merocyanine dyes.

Any nucleus ordinarily utilized in cyanine dyes as a basic heterocyclic nucleus can be present in these dyes. Such basic heterocyclic nuclei include pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei, etc.; nuclei formed by fusing an aliphatic hydrocarbon ring to the aforesaid nuclei, and nuclei formed by fusing an aromatic hydrocarbon ring to the aforesaid nuclei, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc. These nuclei may have substituent(s) on carbon atoms.

5-membered or 6-membered heterocyclic nuclei such as pyrazolin-5-one nuclei, thiohydantoin nuclei, 2-thiooxazolidine-2,4-dione nuclei, thiazolidine-2,4-dione nuclei, rhodanine nuclei, thiobarbituric acid nuclei, etc., may be present in the merocyanine dyes or complex merocyanine dyes as nuclei that have a ketomethylene structure.

These sensitizing dyes may be used singly or in combination. A combination of sensitizing dyes is frequently used for the purpose of supersensitization.

The silver halide emulsion for use in this invention may contain a dye having no spectral sensitizing activity by itself or a substance which does not substantially absorb visible light and shows supersensitizing activity, together with the sensitizing dye(s). For example, the emulsions may contain aminostilbene compounds substituted by a nitrogen-containing heterocyclic nucleus group (e.g., the compounds described in U.S. Pat. Nos. 2,933,390 and 3,635,721), aromatic organic acid-formamide condensation products (e.g., the compounds described in U.S. Pat. No. 3,743,510), cadmium salts, and azaindene compounds. The combinations described in U.S. Pat. Nos. 3,615,613, 3,615,641, 3,617,295, and 3,635,721 are particularly useful.

The silver halide photographic emulsion used in the present invention can further contain various compounds for inhibiting the formation of fog during the production, storage, and photographic processing of the photographic light-sensitive material or for stabilizing the photographic properties. For example, there are many compounds known as antifoggants or stabilizers, such as azoles [e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles and merpcatotetrazoles (in particular, 1-phenyl-5-mercaptotetrazole)]; mercaptopyrimidines; mercaptotriazines; thioketo compounds (e.g., oxazolinethione); azaindenes [e.g., triazaindenes, tetraazaindenes (in particular, 4-hydroxy-substituted (1,3,3a,7)tetraazaindenes), and pentaazaindenes]; benzenethiosulfonic acid; benzenesulfinic acid; and benzenesulfonic acid amide.

The photographic light-sensitive material of the present invention may contain one or more kinds of surface active agents for use as coating aids, static prevention, to improve slidability, to improve emulsified dispersions, to prevent sticking, and to improve photographic characteristics (e.g., accelerating development, increasing contrast, increasing sensitivity, etc.).

The photographic light-sensitive material of the present invention may contain a water-soluble dye in the hydrophilic colloid layer as a filter dye, or as a dye to prevent irradiation, or as a dye to inhibit halation, or for various other purposes.

Preferred examples of such a water-soluble dye include oxonol dyes, hemioxonol dyes, styryl dyes, merocyanine dyes, anthraquinone dyes, and azo dyes. Furthermore, cyanine dyes, azomethine dyes, triarylmethane dyes, and phthalocyanine dyes are also useful as a water-soluble dye. An oil-soluble dye can be incorporated into the hydrophilic colloid layer by emulsifying with an oil drop-in-water dispersion method.

The present invention can be present in a multilayer multicolor photographic material having at least two photographic emulsion layers each having a spectral sensitivity on a support.

A multilayer natural color photographic material usually has at least one red-sensitive emulsion layer, at least one green-sensitive emulsion layer, and at least one blue-sensitive emulsion layer on a support. The arrangement of these emulsion layers can be desirably selected as required.

A preferred order of the emulsion layers is a red-sensitive emulsion layer, a green-sensitive emulsion layer, a blue-sensitive emulsion layer/support, or a blue-sensitive emulsion layer, a green-sensitive emulsion layer, a red-sensitive emulsion layer/support, or a blue-sensitive emulsion layer, a red-sensitive emulsion layer, a green-sensitive emulsion layer/support.

Also, an optional same color-sensitive emulsion layer may be composed of two or more emulsion layers each having a different light sensitivity for improving the range of light sensitivity or a same color-sensitive emulsion layer may be composed of three emulsion layers to improve graininess. Also, a light-insensitive layer may be interposed between two or more emulsion layer each having the same color sensitivity. Furthermore, between emulsion layers having the same color sensitivity, an emulsion layer having a different color sensitivity may be inserted. Also, a reflective layer containing fine silver halide grains may be provided under a high-sensitive emulsion layer, in particular, a high-sensitive blue-sensitive layer to improve the sensitivity.

In general the red-sensitive emulsion layer contains a cyan-forming coupler, the green-sensitive emulsion layer contains a magenta-forming coupler, and the blue-sensitive emulsion layer contains a yellow-forming coupler. If desired, other combinations can be employed. For example, by combining the color-sensitive emulsion layers with an infrared-sensitive layer, the photographic light-sensitive material may be used for a pseudo color photograph or a semiconductor laser exposure.

For producing the photographic light-sensitive material of the present invention, the photosensitive emulsion layers and other layers are coated on a flexible support, which is usually used for photographic light-sensitive materials, such as plastic films, papers, cloths, etc., or a solid support such as glass plates, ceramics, metal sheets, etc.

Examples of the useful flexible support are films of semi-synthetic or synthetic polymers such as cellulose nitrate, cellulose acetate, cellulose acetate butyrate, polystyrene, polyvinyl chloride, polyethylene terephthalate, polycarbonate, etc., and papers coated or laminated with a baryta layer or an $\alpha$-olefin polymer (e.g., polyethylene, polypropylene, and an ethylene/butylene copolymer). The support may be colored with a dye or a pigment. The support may be colored black to shield the light.

The surface of the support is generally subjected to a subbing treatment for improving adhesion with a photographic emulsion layer, etc. Before or after the subbing treatment, the surface of the support may be subjected to a glow discharging treatment, a corona discharging treatment, a ultraviolet irradiation treatment, a flame treatment, etc.

For coating the photographic emulsion layers and other hydrophilic colloid layers, various known coating methods such as a dip coating method, a roller coating method, a curtain coating method, an extrusion coating method, etc., can be utilized. If necessary, multilayers may be coated simultaneously by the coating methods described in U.S. Pat. Nos. 2,681,294, 2,761,791, 3,526,528, and 3,508,947.

The present invention can be applied to various color and black-and-white photographic light-sensitive materials, such as general or movie color negative films, color reversal films for slides or television, color photographic papers, color positive films, color reversal photographic papers, color diffusion transfer type photographic light-sensitive materials, and heat developable type color photographic light-sensitive materials. The present invention ca also be applied to black-and-white light-sensitive materials such as radiographic materials by utilizing a mixture of three color couplers described in *Research Disclosure,* No. 17123 (July, 1978) or by utilizing a black coloring coupler described in U.S. Pat. No. 4,126,461 and British Patent 2,102,136. Furthermore, the present invention can also be applied for printing plate-making films such as lithographic films or scanner films; direct or indirect medical X-ray films or industrial X-ray films; negative black-and-white photographic films for camera use, black-and-white photographic papers, COM or ordinary microfilms, silver salt diffusion transfer type light-sensitive materials, and print-out type light-sensitive materials.

When the photographic material of the present invention is applied to a color diffusion transfer photographic process, a peel apart type, an integrated type described in JP-B-46-16356, JP-B-48-33697, JP-A-50-13040, and British Patent 1,330,524, or a peel apart unnecessary type film unit structure as described in JP-A-57-119345 can be employed.

In any format described above, it is useful for widening the allowable range of the processing temperature to use a polymer acid layer protected by a neutralization timing layer. When the photographic material of this invention is used for a color diffusion transfer photographic process, a polymer acid may be added to any layer of the photographic light-sensitive material or may be incorporated into the processing container as a developer component.

The photographic light-sensitive material of the present invention can be exposed by various means. Any light source emitting a radiation corresponding to the light-sensitive wavelengths of the photographic light-sensitive material can be used as an illuminating light source or a recording light source. For example, natural light (sun light), an incandescent lamp, a halogen atom-containing lamp, a mercury lamp, a fluorescent lamp, and a flash light source such as an electronic flash or a metal burning flash bulb can be generally used. A gas laser, a dye solution laser, or a semiconductor laser, a light emitting diode (LED), and a plasma light source which emit light in the wavelength region of from ultraviolet to infrared can be used as a recording light source.

Further, a fluorescent plane emitting light from a fluorescent substance excited by electron rays (e.g., CRT) or an exposure means composed of a combination of a micro shutter array utilizing a liquid crystal (LCD) or lanthanum-doped lead titaniumzirconate (PLZT) with a line-form or plate-form light source can be used. If necessary, the spectral distribution of a light source which is used for exposure can be controlled by a color filter.

A color developer which is used for developing the photographic light-sensitive material of the present invention is preferably an alkaline aqueous solution containing an aromatic primary amino developing agent as the main component.

As the color developing agent, aminophenol series compounds may be useful but p-phenylenediamine series compounds are preferably used. Typical examples thereof are 3-methyl-4-amino-N,N-diethylaniline, 3-methyl-4-amino-N-ethyl-N-$\beta$-hydroxyethylaniline, 3-methyl-4 amino-N-ethyl-N-$\beta$-methanesulfonamidoethylaniline, 3-methyl-4-amino-N-ethyl-N-$\beta$-methoxyethylaniline, and the sulfates, hydrochlorides, or p-toluenesulfonates, etc., of the above-described compounds. These diamines are preferably used as the salts, rather than as the salt-free compounds, since the salts are generally more stable.

The color developer generally contains a pH buffer such as carbonates, borates, or phosphates of an alkali metal or a development inhibitor or an antifoggant such as bromides, iodides, benzimidazoles, benzothiazoles, and mercapto compounds. Also, if necessary, the color developer may contain a preservative such as hydroxyamines, dialkylhydroxylamines, hydrazines, triethanolamines, triethylenediamine, and sulfites; an organic solvent such as triethanolamine, diethylene glycol, etc.; a development accelerator such as benzyl alcohol, polyethylene glycol, quaternary ammonium salts, amines, etc.; a dye-forming coupler, a competing coupler; a nucleating agent such as sodium borohydride, etc.; an auxiliary developing agent such as 1-phenyl-3-pyrazolidone, etc.; a tackifier; various chelating agents such as aminopolycarboxylic acid, aminopolyphosphoric acid, anlkylphosphonic acid, and phosphonocarboxylic acid; and an antioxidant described in West German Patent Application (OLS) 2,622,950.

In the development process of a reversal color photographic light-sensitive material, after carrying out black-and-white development, color development is usually carried out. For the black-and-white developer, known black-and-white developing agents such as dihydroxybenzenes such as hydroquinone, etc.; 3-pyrazolidones such as 1-phenyl-3-pyrazolidone, etc.; and aminophenols such as N-methyl-p-aminophenol, etc., can be used singly or in combination.

For the photographic light-sensitive materials, not only a color developer but also any photographic developing process may be used.

Developing agents which can be used for a developer include dihydroxybenzene series developing agents, 1-phenyl-3-pyrazolidone series developing agents, and p-aminophenol series developing agents, and they can be used singly or as a combination thereof (e.g., a combination of a 1-phenyl-3-pyrazolidone and a dihydroxybenzene or a combination of a p-aminophenol and a dihydroxybenzene).

Also, the photographic light-sensitive material of the present invention may be processed with an infectious developer using a sulfite ion buffer such as carbonyl bisulfite together with hydroquinone.

Examples of the above-described dihydroxybenzene series developing agent include hydroquinone, chlorohydroquinone, bromohydroquinone, isopropylhydroquinone, toluhydrohydroquinone, methylhydroquinone, 2,3-dichlorohydroquinone, and 2,5-dimethylhydroquinone; examples of the 1-phenyl-3-pyrazolidone series developing agent are 1-phenyl-3-pyrazolidone, 4,4-dimethyl-1-phenyl-3-pyrazolidone, 4-hydroxymethyl-4-methyl-1-phenyl-3-pyrazolidone, and 4,4-dihydroxymethyl-1-phenyl-3-pyrazolidone, and examples of the p-aminophenol series developing agent are p-aminophenol and N-methyl-p-aminophenol.

The developer also can contain a compound providing free sulfite ions as a preservative, for example, sodium sulfite, potassium sulfite, potassium metabisulfite, and sodium bisulfite. In the case of an infectious developer, a formaldehyde sodium bisulfite condensation product, which hardly provides any free sulfite ions in the developer, may be used.

As the alkali agent contained in the developer, potassium hydroxide, sodium hydroxide, potassium carbonate, sodium carbonate, sodium acetate, potassium tertiary phosphate, diethanolamine, triethanolamine, etc., can be used. The pH of the developer is usually at least 9 and is preferably at least 9.7.

The developer may contain an organic compound as an antifoggant or a development inhibitor. Examples thereof include azoles such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole), etc.; mercaptopyrimidines; mercaptotriazines; thioketo compounds such as oxazolinethione, etc.; azaindenes such as triazaindenes, tetraazaindenes (in particular, 4-hydroxy-substituted 1,3,3a,7)-tetraazaindenes), pentaazaindenes, etc.; benzenethiosulfonic acid, benzenesulfinic acid, benzenesulfonic acid amide, and sodium 2-mercaptobenzimidzole-5-sulfonate.

The developer for use in the present invention may contain a polyalkylene oxide as a development inhibitor as described above. For example, a polyethylene oxide having a molecular weight of from 1000 to 10,000 can be used in an amount of 0.1 to 10 g/liter.

The developer for use in this invention preferably contain nitrilotriacetic acid, ethylenediamine tetraacetic acid, triethylenetetramine, acetic acid, diethylenetetraminepentaacetic acid, etc., as a water softener.

The developer for use in this invention can contain compounds described in JP-A-56-24347 as a silver stain inhibitor, compounds described in JP-A-62-212651 as an uneven development inhibitor, and compounds described in JP-A-61-267759 as a dissolution aid.

Furthermore, the developer for use in this invention can contain boric acid described in JP-A-62-186259, saccharose described in JP-A-60-93433, oximes (e.g., acetoxime), phenols (e.g., 5-sulfosalicylic acid), yertiary phosphates (e.g., the sodium salt and the potassium salt), etc., as a buffer.

As the development accelerator for use in the present invention, various known compounds can be used, and these compound may be incorporated in the photographic light-sensitive materials or the developer. Examples of the preferred development accelerator are amine series compounds, imidazole series compounds, imidazoline series compounds, phosphonium series compounds, sulfonium series compounds, hydrazine series compounds, thioether series compounds, thione series compounds, certain kinds of mercapto compounds, mesoion series compounds, and thiocyanates.

In particular, for carrying out a rapid development process, a development accelerator is necessary. It is desirable that a development accelerator is added to the color developer, but according to the kind of development accelerator or a position of a light-sensitive layer to be subjected to development acceleration on a support, the accelerator can be incorporated into the photographic light-sensitive material. Also, the development accelerator may be incorporated into both the color developer and the photographic light-sensitive material. Furthermore, as desired, a pre-bath for the color development bath may be formed, and the development accelerator may be added to the pre-bath.

Amino compounds useful in the present invention as the amino compound include both inorganic amines such as hydroxylamine and organic amines. As the organic amine, aliphatic amines, aromatic amines, cyclic amines, aliphatic-aromatic mixed amines, or heterocyclic amines can be used. Also, primary, secondary, and tertiary amines and quaternary ammonium compounds are all effective.

After color development, the photographic emulsion layers are usually bleached. Bleaching may be carried out simultaneously with or separately from fixing. Furthermore, for quickening photographic processing, after bleaching, a blixing treatment may be applied.

Bleaching agents include, for example, compounds of a polyvalent metal such as iron (III), cobalt(III), chromium(IV), copper(II), etc., peracids, quinones, and nitron compounds. Typical examples of a bleaching agent are ferricyanides, bichromates, organic complex salts of iron(III) or cobalt(III), such as the complex salts of aminopolycarboxylic acids (e.g., ethylenediaminetetraacetic acid, diethylenetriaminepentaacetic acid, nitrilotriacetic acid, and 1,3-diamino-2-propanoltetraacetic acid) or organic acids (e.g., citric acid, tartaric acid, and malic acid); persulfates, manganates, and nitrosophenol. In these compounds, ethylenediaminetetraacetic acid iron(III) salts, diethylenetriaminepentaacetic acid iron(III) salts, and persulfates are preferred from the view points of quick processing and less environmental pollution. Furthermore, an ethylenediaminetetraacetic acid iron(III) salt is particularly useful for an independent bleach solution and a blix solution.

For the bleach solution, the blix solution and the pre-bath thereof, if necessary, a bleach accelerator can be used.

Specific examples of the bleach accelerator are the compounds having a mercapto group or a disulfide group described in U.S. Pat. No. 3,893,858, West German Patents 1,290,812 and 2,059,988, JP-A-53-32736, JP-A-53-57831, JP-A-53-37418, JP-A-53-65732, JP-A-53-72623, JP-A-53-95630, JP-A-53-95631, JP-A-53-104232, JP-A-53-124424, JP-A-53-141623, JP-A-53-28426, and *Research Disclosure;* thiazolidine derivatives described in JP-A-50-140129; thiourea derivatives described in JP-B-45-8506, JP-A-52-20832, JP-A-53-32735, and U.S. Pat. No. 3,706,561; iodides described in West German Patent 1,127,715 and JP-A-58-16235; polyethylene oxides described in West German Patents 966,410 and 2,748,430; polyamine compounds described in JP-B-45-8836; the compounds described in JP-A-49-

42434, JP-A-49-59644, JP-A-53-94927, JP-A-54-35727, JP-A-55-26506, and JP-A-58-163940; and iodine and bromine ions.

In these compounds, compounds having a mercapto group or a disulfide group are preferred because they provide a large acceleration effect and in particular, the compounds described in U.S. Pat. No. 3,893,858, West German Patent 1,290,812, and JP-A-53-95630 are preferred. Furthermore, compounds described in U.S. Pat. No. 4,552,834 are also preferred. These bleach accelerators may be added to a light-sensitive material. When a color photographic material for photographing (in camera use) is blixed, these bleach accelerators are particularly effective.

Fixing agents include thiosulfates, thiocyanates, thioether series compounds, thioureas, and a large amount of an iodide, but thiosulfates are generally used.

As a preservative for the blixing solution or the fixing solution, sulfites, bisulfites, or carbonyl bisulfite addition products are preferable.

After blixing or fixing, washing or stabilization is usually carried out. In the washing and stabilizing steps, various compounds may be used for the purposes of preventing precipitation and saving water. For example, for precipitation, a water softener such as inorganic phosphoric acids, aminopolycarboxylic acids, organic aminopolyphosphonic acids, organic phosphoric acids, etc.; germicides or antifungal agents for preventing the growth of various kind of bacteria, algae, and molds; metal salts such as magnesium salts, aluminum salts, and bismuth salts; surface active agents for preventing drying load and uneven drying; and various hardening agents can be, if necessary, added thereto. Moreover, the compounds described in L. E. West, *Phot. Sci. Eng.*, Vol. 6, 344–359(1965) may be added. The addition of a chelating agent or an antifungal agent is particularly effective.

The washing step is generally carried out using 2 or more baths by a countercurrent system for saving water. Furthermore, in place of the wash step, the multistage countercurrent stabilization step described in JP-A-57-8543 may be employed. This step requires 2 to 9 countercurrent baths. To the stabilizing solution various kinds of compounds are added for stabilizing images formed in addition to the above-described additives. Examples of these compounds are various buffers for adjusting pH of the layers, for example, pH of from 3 to 9. Examples of buffers include a combination of, for example, borates, metaborates, borax, phosphates, carbonates, potassium hydroxides, sodium hydroxide, aqueous ammonia, monocarboxylic acid, dicarboxylic acid, polycarboxylic aid, etc.; and aldehydes such as formalin. Furthermore, if necessary, chelating agents (e.g., inorganic phosphoric acids, aminopolycarboxylic acids, organic phosphoric acids, organic phosphonic acids, aminopolysulfonic acid, and phosphonocarboxylic acids), germicides (e.g., benzoisothiazolinone, isothiazolone, 4-thiazolinebenzimidazole, halogenated phenols, sulfanylamide, and benzotriazole), surface active agents, brightening agents, hardening agents, etc., may be used, and two or more compounds having the same or different purpose may be used together.

Also, as the pH controlling agent for layers after processing, it is preferable to add various ammonium salts such as ammonium chloride, ammonium nitrate, ammonium sulfate, ammonium phosphate, ammonium sulfite, ammonium thiosulfate, etc., to the stabilization solution.

For the color photographic material for photographing, a wash-stabilizing step which is usually carried out after fixing may be replaced with the above-described stabilizing step and washing step (water-save processing). In this case, when a two equivalent magenta coupler is used, formalin may be removed from the stabilization solution.

The washing time and the stabilizing time differ according to the kind of photographic light-sensitive material and the processing conditions but is usually from 20 seconds to 10 minutes, and preferably from 20 seconds to 5 minutes for each step.

The silver halide color photographic material of the present invention may contain a color developing agent for simplifying and quickening processing. For incorporating the color developing agent in the photographic light-sensitive material, it is preferable to use various precursors for the color developing agents.

For example, there are indoaniline series compounds described in U.S. Pat. No. 3,342,597, the Schiff base type compounds described in U.S. Pat. No. 3,342,599, *Research Disclosure,* No. 14850, and ibid., No. 15159, aldol compounds described in *Research Disclosure,* No. 13924, metal salt complexes described in U.S. Pat. No. 3,719,492, urethane series compounds described in JP-A-53-135628, and various salts type precursors described in JP-A-56-6235, JP-A-56-16133, JP-A-56-59232, JP-A-56-67842, JP-A-56-83734, JP-A-56-83735, JP-A-56-83736, JP-A-56-89735, JP-A-56-81837, JP-A-56-54430, JP-A-56-6241, JP-A-107236, JP-A-57-97531, and JP-A-57-83565.

The silver halide color photographic material of the present invention may, if necessary, contains various kinds of 1-phenyl-3-pyrazolidones for accelerating the color development. Typical compounds are described in JP-A-56-64339, JP-A-57-144547, JP-A-57-211147, JP-A-58-50532, JP-A-58-50536, JP-A-58-50533, JP-A-58-50534, JP-A-58-50535, and JP-A-58-115438.

The various processing solutions for processing the photographic light-sensitive materials of the present invention are used at a temperature of from 10° C. to 50° C. The standard processing temperature is from 33° C. to 38° C. However, a higher temperature can be employed for accelerating processing to shorten the processing time, or a lower temperature can be employed for improving the image quality and improving the stability of the processing solutions. Furthermore, for saving silver of the photographic light-sensitive material, processing using cobalt intensification or hydrogen peroxide intensification described in West German Patent 2,226,770 and U.S. Pat. No. 3,674,499 may be employed in this invention.

If necessary, each processing bath may be equipped with a heater, a temperature sensor, a liquid level sensor, a circulating pump, a filter, a floating lid, a squeegee, etc.

Also, when using continuous processing, a constant finish is obtained by preventing the deviation of the composition of processing solutions by using a replenisher for each processing solution. The replenishing amount can be reduced to a half or lower of a standard replenishing amount for reducing cost, etc.

When the photographic light-sensitive material of the present invention is a color photographic paper, a blixing process is generally employed. In the case of a color photographic material for photographing, if necessary, blixing may also be employed.

The silver halide photographic material of the present invention has the excellent effect that the dye in the dye layer has an adequate spectral absorption, selectively dyes the dye layer, and does not diffuse into other layers.

Also, the silver halide photographic material containing the dye of this invention has the effect that the dye is easily decolorized or dissolved out by photographic processing to give low Dmin without reducing the sensitivity. Further, the photographic material shows less reduction of sensitivity after storage.

Additionally, the silver halide photographic material of the present invention gives color images having improved sharpness. The photographs obtained from the silver halide photographic material of this invention can be stably stored for a long period of time without causing stains and without reducing the photographic performance.

Then, the invention is described in more detail based on the following example which is illustrative and does not limit the invention in any way.

EXAMPLE

Preparation of Dye-Fixing Layer

Each of the dyes described in Table 1 below was processed in a ball mill by the method described in JP-A-63-197943.

Then, 434 ml of water and 791 ml of a 6.7% aqueous solution of a surface active agent, Triton X-200R (TX-200R) (trade name, made by Rohm & Haas Co.) were placed in a 2 liter ball mill and 20 g of the dye was added to the solution. Then, after adding thereto 400 ml of beads (diameter 2 mm) of zirconium oxide (ZrO), the mixture was pulverized for 4 days. Thereafter, 160 g of 12.5% aqueous gelatin solution was added thereto.

When the dye dispersion thus obtained was observed, the diameters of the dye particles thus pulverized had a wide distribution from 0.05 μm to 1.15 μm in diameter.

As a support, a transparent polyethylene terephthalate (PET) film support having a thickness of 100 μm was used. For improving the adhesion for a hydrophilic colloid layer, the surface of the support was previously subjected to a corona discharging treatment, then a 1st subbing layer composed of a styrene-butadiene latex was formed on the support, and a 2nd subbing layer of 0.08 g/m$^2$ of gelatin was further formed thereon.

On the support a gelatin dispersion of the above-described fine dye dispersion was coated in the amount shown below. Thus, an antihalation layer was prepared.

| | |
|---|---|
| Gelatin | 1.8 g/m$^2$ |
| Dye I-3 | The amount shown in Table 1 below. |
| Potassium Polystyrenesulfonate (mean molec. weight 600,000) | 35 mg/m$^2$ |
| 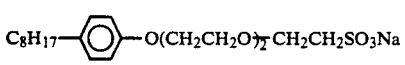 | 10 mg/m$^2$ |
| Phenoxyethanol | 18 mg/m$^2$ |
| 1,2-Bis(vinylsulfonylacetamido)ethane | 100 mg/m$^2$ |

Preparation of Emulsion Coating Composition

Emulsion #1 shown below is a surface latent image-type silver halide emulsion and negative type characteristics are obtained by a commercially available processing solution for microfilm. Furthermore, positive type characteristics are obtained by applying reversal processing using a processing solution for reversal.

| Preparation of Emulsion #1 | |
|---|---|
| Solution I 75° C. | |
| Inactive Gelatin | 24 g |
| Distilled Water | 900 ml |
| Potassium Bromide | 4 g |
| Aqueous 10% Phosphoric Acid Soln. | 2 ml |
| Sodium Benzenesulfinate | $5 \times 10^{-1}$ mol |
| 1,2-Bis(2-hydroxyethylthio)ethane | $2.5 \times 10^{-3}$ g |
| Solution II 35° C. | |
| Silver Nitrate | 170 g |
| Distilled water to make | 1000 ml |
| Solution III 35° C. | |
| Potassium Bromide | 230 g |
| Distilled water to make | 1000 ml |
| Solution IV Room temperature | |
| Hexacyano Iron (III) Potassium | 3.0 g |
| Distilled water to make | 100 ml |

To solution I while stirring well were simultaneously added solution II and solution III over a period of 45 minutes and at the end of adding the total amount of the solutions, a cubic grain monodisperse silver halide emulsion having a mean grain size of 0.28 μm was finally obtained.

In this case, the addition rate of solution III was controlled to the addition of solution II such that the pAg value in the mixing container became always 7.50. In addition, solution IV was added thereto after 7 minutes since the initiation of the addition of solution II over a period of 5 minutes. After finishing the addition of solution II, the emulsion obtained was washed with water by a flocculation method, and after desalting, the emulsion was dispersed in an aqueous solution containing 100 g of inactive gelatin. To the emulsion were added 34 mg of sodium thiosulfate and 34 mg of chloroauric acid tetra-hydrate per mole of silver to adjust the pH value and the pAg value to 8.9 and 7.0 (40° C.), respectively and then the emulsion was subjected to a chemical sensitization treatment at 75° C. for 60 minutes to provide a surface latent image type silver halide emulsion.

The layer structure of the light-sensitive material and the composition of each layer were as follows.

| Layer Structure | Thickness (μm) |
|---|---|
| i) Protective Layer | 1.0 |
| ii) Emulsion Layer | 2.0 |
| iii) Dye Layer (Antihalation layer) | 1.8 |
| iv) Support | 100 |
| v) Back Electrically Conductive Layer | 0.2 |
| vi) Gelatin Layer | 1.4 |

The emulsion layer, the surface protective layer, the back electrically conductive layer, and gelatin layer other than the antihalation layer were coated as shown below to provide a photographic light-sensitive material.

| | Coated Amount |
|---|---|
| Protective Layer | |
| Inactive Gelatin | 1300 mg/m$^2$ |
| Colloidal Silica | 249 mg/m$^2$ |

-continued

| | Coated Amount |
|---|---|
| Fluid Paraffin | 60 mg/m$^2$ |
| Strontium Barium Sulfate (mean particle size 1.5 μm) | 32 mg/m$^2$ |
| 1,2-Benzoisothiazolin-3-one | 4.3 mg/m$^2$ |
| N-perfluorooctanesulfonyl-N-propylglycine Potassium Salt | 5.0 mg/m$^2$ |
| 1,3-Bis(vinylsulfonyl)-2-propanol | 56 mg/m$^2$ |
| 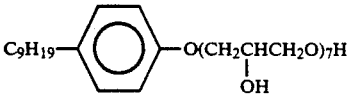 | 15 mg/m$^2$ |
| Emulsion Layer | |
| Silver Halide Emulsion | 1700 mg/m$^2$ as Ag |
| Sensitizing Dye (Compound (a)) | 23.8 mg/m$^2$ |
| 5-Methylbenzotriazole | 4.1 mg/m$^2$ |
| Sodium Dodecylbenzenesulfonate | 5 mg/m$^2$ |
| 1,3-Bis(vinylsulfonyl)-3-propanol | 56 mg/m$^2$ |
| Sodium Polystyrenesulfonate | 35 mg/m$^2$ |
| Sensitizing dye (Compound (a)) | |
| 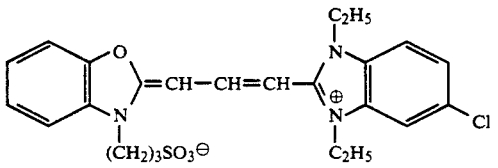 | |
| Back Electrically Conductive Layer | |
| $SnO_2$/Sb (9/1 by weight ratio, mean particle size 0.25 μm) | 300 mg/m$^2$ |
| Inactive Gelatin | 170 mg/m$^2$ |
| 1,2-Benzoisothiazolin-3-one | 7 mg/m$^2$ |
| Sodium Dodecylbenzenesulfonate | 10 mg/m$^2$ |
| Sodium Dihexyl-α-sulfosuccinate | 40 mg/m$^2$ |
| Sodium Polystyrenesulfonate | 9 mg/m$^2$ |
| Gelatin Layer | |
| Inactive Gelatin | 1580 mg/m$^2$ |
| Strontium Barium Sulfate (mean particle size 1.5 μm) | 50 mg/m$^2$ |
| Liquid Paraffin | 60 mg/m$^2$ |
| N-perfluorooctanesulfonyl-N-propylglycine Potassium Salt | 5 mg/m$^2$ |
| Sodium Dodecylbenzenesulfonate | 9 mg/m$^2$ |
| Sodium Dihexyl-α-sulfosuccinate | 34 mg/m$^2$ |
| Sodium Polystyrenesulfonate | 4 mg/m$^2$ |
| 1,2-Benzoisothiazolin-3-one | 5 mg/m$^2$ |

Two comparison samples were prepared in the same manner as above, except that one comparison sample did not contain any dye in the Antihalation Dye Layer, and the other comparison sample contained a Comparison Dye A instead of Dye I-3.

The samples were subjected to reversal development processing and negative development processing as described below.

Processing Process

Reversal Development Process

The reversal development process was carried out under the following conditions using a reversal deep tank automatic processor F-10R, trade name, made by Allen Products Co., U.S.A., with a commercially available reversal processing solution, FR-531, 532, 533, 534, and 535 (trade names, made by FR Chemicals Co., U.S.A.)

| Step | Processing Soln. | Temp. | Time |
|---|---|---|---|
| 1. 1st Development | FR-531 (1:3) | 43° C. | 15 sec. |
| 2. Wash | Running water | " | " |
| 3. Bleach | FR-532 (1:3) | " | " |
| 4. Cleaning | FR-533 (1:3) | " | " |
| 5. Exposure | — | — | — |
| 6. 2nd Development | FR-534 (1:3) | 43° C. | 15 sec. |
| 7. Fix | FR-535 (1:3) | " | " |
| 8. Wash | Spray | " | " |
| 9. Drying | Hot blast | — | — |

Negative Development Process

The negative development process was carried out under the following conditions using a deep tank automatic processor, F-10, made by Allen Products Co., U.S.A. with a commercially available processing solution for microfilm, FR-537 Developer (trade name, made by FR Chemicals Co., U.S.A.).

| Step | Processing Soln. | Temp. | Time |
|---|---|---|---|
| 1. Development | FR-537 (1:3) | 43° C. | 15 sec. |
| 2. Wash | Running water | " | " |
| 3. Fix | FR-535 (1:3) | " | " |
| 4. Wash | Spray | " | " |
| 5. Drying | Hot blast | — | — |

Evaluation of Sharpness

The sharpness was evaluated by MTF. Each photographic light-sensitive material was exposed by white light for 1/100 second using an MTF measurement wedge and processed by the above-described automatic processor.

MTF was measured with an aperture of 400×2 μm$^2$ and the sharpness was evaluated at the portion of the optical density being 1.0 using the MTF value of 20 cycles/mm in space frequency.

The results obtained are shown in Table 1 below.

Evaluation of Residual color

After processing each unexposed film using the above-described automatic processor, a green transmission density and a blue transmission density were measured through a Macbeth Status A filter.

The results are also shown in Table 1 below.

TABLE 1

| | | Reversal Development Process | | | Negative Development Process | | |
|---|---|---|---|---|---|---|---|
| | Kind and Amount of Dye | MTF | Green Transmission Density After Processing | Blue Transmission Density After processing | MTF | Green Transmission Density After Processing | Blue Transmission Density After processing |
| Comparison | — | 0.80 | 0.03 | 0.04 | 0.79 | 0.04 | 0.04 |
| Invention | I-3 (140 mg/m$^2$) | 1.03 | 0.04 | 0.04 | 1.02 | 0.04 | 0.06 |
| Comparison | A (140 mg/m$^2$) | 0.95 | 0.04 | 0.04 | 0.96 | 0.04 | 0.05 |

As is clear from the results shown in Table 1 above, it can be seen that according to this invention, a photographic light-sensitive material providing images having excellent sharpness and less residual color is obtained.

Comparison Dye A:

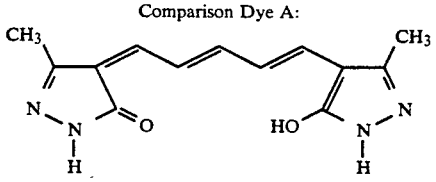

While the invention has been described in detail and with reference to specific embodiments thereof, it will be apparent to one skilled in the art that various changes and modifications can be made therein without departing from the spirit and scope thereof.

What is claimed is:

1. A silver halide photographic element comprising on a support a hydrophilic colloid layer, the hydrophilic colloid layer being a silver halide emulsion layer or other layer, said hydrophilic colloid layer containing at least one 2-pyrazolin-5-one oxonol dye represented by general formula (I) in an amount of from 1 to 1000 mg/m$^2$ in the form of a dispersion of fine solid particles thereof wherein the mean particle size of the fine solid particles is from 0.05 to 10 $\mu$m

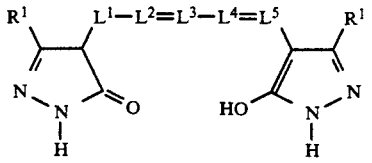

(I)

wherein $R^1$ represents a hydrogen atom, an aryl group, a cyano group, a halogen atom, —$COOR^2$, —$COR^3$, —$CONR^3R^4$, —$OR^2$, —$NHCOR^3$, or —$N^3R^4$, wherein $R^2$ represents an alkyl group or an aryl group and $R^3$ and $R^4$ each represents a hydrogen atom, an alkyl group, or an aryl group; and $L^1$, $L^2$, $L^3$, $L^4$, and $L^5$ each represents a methine group.

2. A silver halide photographic element as in claim 1, wherein $R^1$ represents —$OR^2$, and $R^2$ is an alkyl group which has from 1 to 5 carbon atoms.

3. A silver halide photographic element as in claim 1, wherein the compound of formula (I) is present in an amount of from 1 to 800 mg/m$^2$.

4. A silver halide photographic element as in claim 1, wherein the mean particle size of the fine solid particles in the dispersion is not larger than 2 $\mu$m.

5. A silver halide photographic material as in claim 1, wherein the mean particle size of the fine solid particles in the dispersion is not larger than 0.5 $\mu$m.

6. A silver halide photographic element as in claim 1, wherein the mean particle size of the fine solid particles in the dispersion is not larger than 0.1 $\mu$m.

* * * * *

UNITED STATES PATENT AND TRADEMARK OFFICE

CERTIFICATE OF CORRECTION

PATENT NO. : 5,238,798

DATED : August 24, 1993

INVENTOR(S) : Takashi Usami

It is certified that error appears in the above-indentified patent and that said Letters Patent is hereby corrected as shown below:

In the Abstract, line 6, please delete formula (I) and insert the following corrected formula (I):

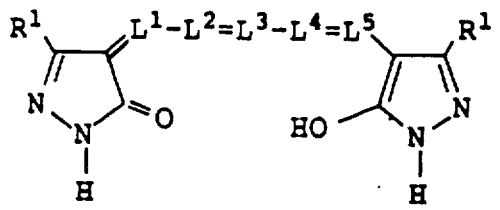

(I)

Column 3, line 1, please delete formula (I) and insert the following corrected formula (I):

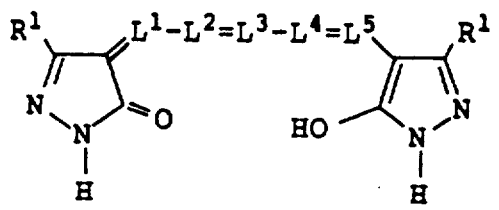

(I)

UNITED STATES PATENT AND TRADEMARK OFFICE

CERTIFICATE OF CORRECTION

PATENT NO. : 5,238,798 Page 2 of 2

DATED : August 24, 1993

INVENTOR(S) : Takashi Usami

It is certified that error appears in the above-indentified patent and that said Letters Patent is hereby corrected as shown below:

Column 20, line 1, please delete formula (I)

and insert the following corrected formula (I):

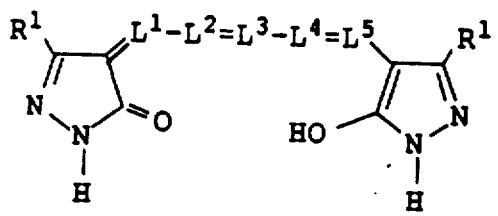

(I)

Signed and Sealed this

Twelfth Day of April, 1994

*Attest:*

*Attesting Officer*

BRUCE LEHMAN

*Commissioner of Patents and Trademarks*